US009286830B2

(12) United States Patent
Tsuge

(10) Patent No.: US 9,286,830 B2
(45) Date of Patent: Mar. 15, 2016

(54) DISPLAY APPARATUS

(71) Applicant: PANASONIC CORPORATION, Osaka (JP)

(72) Inventor: Hitoshi Tsuge, Osaka (JP)

(73) Assignee: JOLED INC, Tokyo (JP)

( * ) Notice: Subject to any disclaimer, the term of this patent is extended or adjusted under 35 U.S.C. 154(b) by 0 days.

(21) Appl. No.: 13/969,358

(22) Filed: Aug. 16, 2013

(65) Prior Publication Data

US 2013/0328753 A1 Dec. 12, 2013

Related U.S. Application Data

(63) Continuation of application No. PCT/JP2012/005003, filed on Aug. 7, 2012.

(30) Foreign Application Priority Data

Aug. 9, 2011 (JP) ..... 2011-173509

(51) Int. Cl.
*G09G 3/30* (2006.01)
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0852* (2013.01);
(Continued)

(58) Field of Classification Search
CPC ..... G09G 3/30; G09G 3/20; G09G 3/3233; G09G 3/3291; G09G 2300/0819; G09G 2300/0852; G09G 2300/0861; G09G 2310/0262; G09G 2310/067; G09G 2320/043
USPC ..... 345/44–82, 204–215
See application file for complete search history.

(56) References Cited

U.S. PATENT DOCUMENTS 6,583,775 B1 6/2003 Sekiya et al.
8,089,430 B2 1/2012 Ilda et al.
8,730,135 B2 5/2014 Iida et al.
(Continued)

FOREIGN PATENT DOCUMENTS

CN 101286291 A 10/2008
JP 2001-042822 A 2/2001
(Continued)

OTHER PUBLICATIONS

International Search Report issued in International Patent Application No. PCT/JP2012/005003 mailed on Nov. 6, 2012.
(Continued)

*Primary Examiner* — Kent Chang
*Assistant Examiner* — Mark Edwards
(74) *Attorney, Agent, or Firm* — McDermott Will & Emery LLP

(57) ABSTRACT

A pixel circuit has a first capacitor having a first terminal connected with a gate of a driving transistor; a second capacitor connected between a second terminal of the first capacitor and a source of the driving transistor; a first switch applying a reference voltage to a node at which the first capacitor and the second capacitor are connected; a second switch supplying an image signal voltage to the gate of the driving transistor; a third switch supplying an initialization voltage to a drain of the driving transistor and a fourth switch supplying current to the drain of the transistor for emitting light from the current light emitting device.

10 Claims, 12 Drawing Sheets

(52) U.S. Cl.
CPC ..... *G09G 2300/0861* (2013.01); *G09G 2310/0262* (2013.01); *G09G 2310/067* (2013.01); *G09G 2320/043* (2013.01)

(56) References Cited

U.S. PATENT DOCUMENTS

| | | | | |
|---|---|---|---|---|
| 2002/0047839 | A1 | 4/2002 | Kasai | |
| 2004/0233143 | A1 | 11/2004 | Kasai | |
| 2005/0269959 | A1* | 12/2005 | Uchino et al. | 315/169.3 |
| 2006/0022909 | A1* | 2/2006 | Kwak et al. | 345/76 |
| 2006/0208971 | A1 | 9/2006 | Deane | |
| 2007/0085847 | A1* | 4/2007 | Shishido | 345/204 |
| 2008/0252626 | A1 | 10/2008 | Iida et al. | |
| 2009/0115707 | A1 | 5/2009 | Park et al. | |
| 2009/0231308 | A1 | 9/2009 | Numao | |
| 2010/0039458 | A1* | 2/2010 | Nathan et al. | 345/698 |
| 2010/0309187 | A1* | 12/2010 | Kang et al. | 345/211 |
| 2012/0092391 | A1 | 4/2012 | Iida et al. | |
| 2014/0320548 | A1 | 10/2014 | Iida et al. | |

FOREIGN PATENT DOCUMENTS

| | | | | |
|---|---|---|---|---|
| JP | 2001-060076 | A | | 3/2001 |
| JP | 2002-169510 | A | | 6/2002 |
| JP | 2002-169510 | A | | 6/2002 |
| JP | 2004246204 | A | * | 9/2004 |
| JP | 2005-189695 | A | | 7/2005 |
| JP | 2006-208746 | A | | 8/2006 |
| JP | 2006-525539 | A | | 11/2006 |
| JP | 2009-169145 | A | | 7/2009 |
| JP | 2010-282169 | A | | 12/2010 |
| KR | 10-2011-0043259 | A | | 4/2011 |
| WO | WO-2006/103797 | A1 | | 10/2006 |

OTHER PUBLICATIONS

Office Action with Search Reoprt dated Mar. 17, 2015 for the corresponding Chinese Patent Application No. 201280010975.1 (with English translation of Search Report).

Office Action dated Oct. 19, 2015 issued in Chinese Patent Application No. 201280010975.1 (partial translation).

* cited by examiner

DISPLAY APPARATUS

RELATED APPLICATIONS

This application is the Continuation of International Application No. PCT/JP2012/005003, filed on Aug. 7, 2012, which in turn claims the benefit of Japanese Application No. 2011-173509, filed on Aug. 9, 2011, the disclosures of which Applications are incorporated by reference herein.

TECHNICAL FIELD

The present disclosure relates to an active-matrix display apparatus employing a current light emitting device.

BACKGROUND

An organic EL (electroluminescence) display apparatus has a large number of arrayed self-luminous organic EL devices. The EL display apparatus does not require a backlight and does not have any viewing angle restrictions. Accordingly, it has been developed as a next generation display apparatus.

The organic EL device is a current light emitting device which can control luminosity with an amount of current flow. Methods for driving the organic EL device include a simple-matrix method and an active-matrix method. The simple-matrix method allows a pixel circuit to be made simple but it is difficult to achieve a large-sized and high definition display. For this reason, recently the active-matrix organic EL display apparatus, which has driving transistors for every pixel circuit, is mainly used.

The driving transistor and its peripheral circuit are formed generally of TFT (Thin Film Transistors) made of poly-silicon or amorphous silicon. Although TFT has the disadvantage of a high threshold voltage fluctuation due to its low mobility, it is suitable for a large-sized organic EL display apparatus because large sized TFT is easy to make and the cost of TFT is low. Further, a method for overcoming the disadvantage (fluctuation of threshold voltage) has been studied by improving a pixel circuit. For example, Patent Literature JP2009-169145A1 describes an organic EL display apparatus which compensates the threshold voltage of the driving transistor.

The compensation of threshold voltage is performed as follows. First, a voltage larger than the threshold voltage of the driving transistor is applied between a gate and source of the driving transistor in order to generate a current-flow in the driving transistor and to discharge a capacitor which is connected between the gate and the source of the driving transistor. The current in the driving transistor stops flowing when a terminal to terminal voltage of the capacitor (i.e. voltage between two terminals of the capacitor) decreases to the threshold voltage of the driving transistor. Then, this terminal to terminal voltage is added to an image signal. An image is thereby displayed independently of the threshold voltage of the driving transistor.

If the terminal to terminal voltage of the capacitor is much higher than the threshold voltage, the capacitor is discharged rapidly because the current flowing in the driving transistor is large. However, as the terminal to terminal voltage of capacitor decreases toward the threshold voltage, the amount of current flowing in the driving transistor decreases. As a result, the discharging speed of the capacitor becomes slow. Thus, a long time is required before the terminal to terminal voltage of the capacitor falls to the threshold voltage of the driving transistor. Practically, 10-100 micro-seconds, for example, may be required.

However, according to the pixel circuit and the driving method described in the JP2009-169145A1, a data line for supplying an image signal is also used for compensating the threshold voltage. This limits the time available for the writing operation and makes it difficult to achieve a large-sized or high definition display apparatus having a large numbers of pixels.

SUMMARY

One aspect of the present disclosure relates to a display apparatus having a plurality of arrayed pixel circuits, each of the circuits includes:

a current light emitting device;

a driving transistor supplying current to the current light emitting device;

a first capacitor having a first terminal connected with a gate of the driving transistor;

a second capacitor connected between a second terminal of the first capacitor and a source of the driving transistor;

a first switch applying a reference voltage to a node of the first capacitor and the second capacitor to which the first capacitor and the second capacitor are connected;

a second switch supplying an image signal voltage to the gate of the driving transistor;

a third switch supplying an initialization voltage to a drain of the driving transistor;

a fourth switch supplying current for emitting light from the current light emitting device, and a fifth switch applying the reference voltage to the gate of the driving transistor.

The foregoing structure allows performing a writing operation at a high speed, and compensating the threshold value voltage of the driving transistor.

DETAILED DESCRIPTION

The embodiments of a display apparatus of the present disclosure will be described hereafter with reference to the accompanying drawings. The present disclosure describes an active-matrix organic EL display apparatus which drives EL devices using a driving transistor as an example of the display apparatus. The present disclosure is not limited to the organic EL display apparatus, and may be applicable to various active-matrix display apparatus employing arrayed pixel circuits, each having a current light emitting device that controls luminosity with an amount of current flow, and a driving transistor which supplies current to the current light emitting device.

First Embodiment

Figure 1:
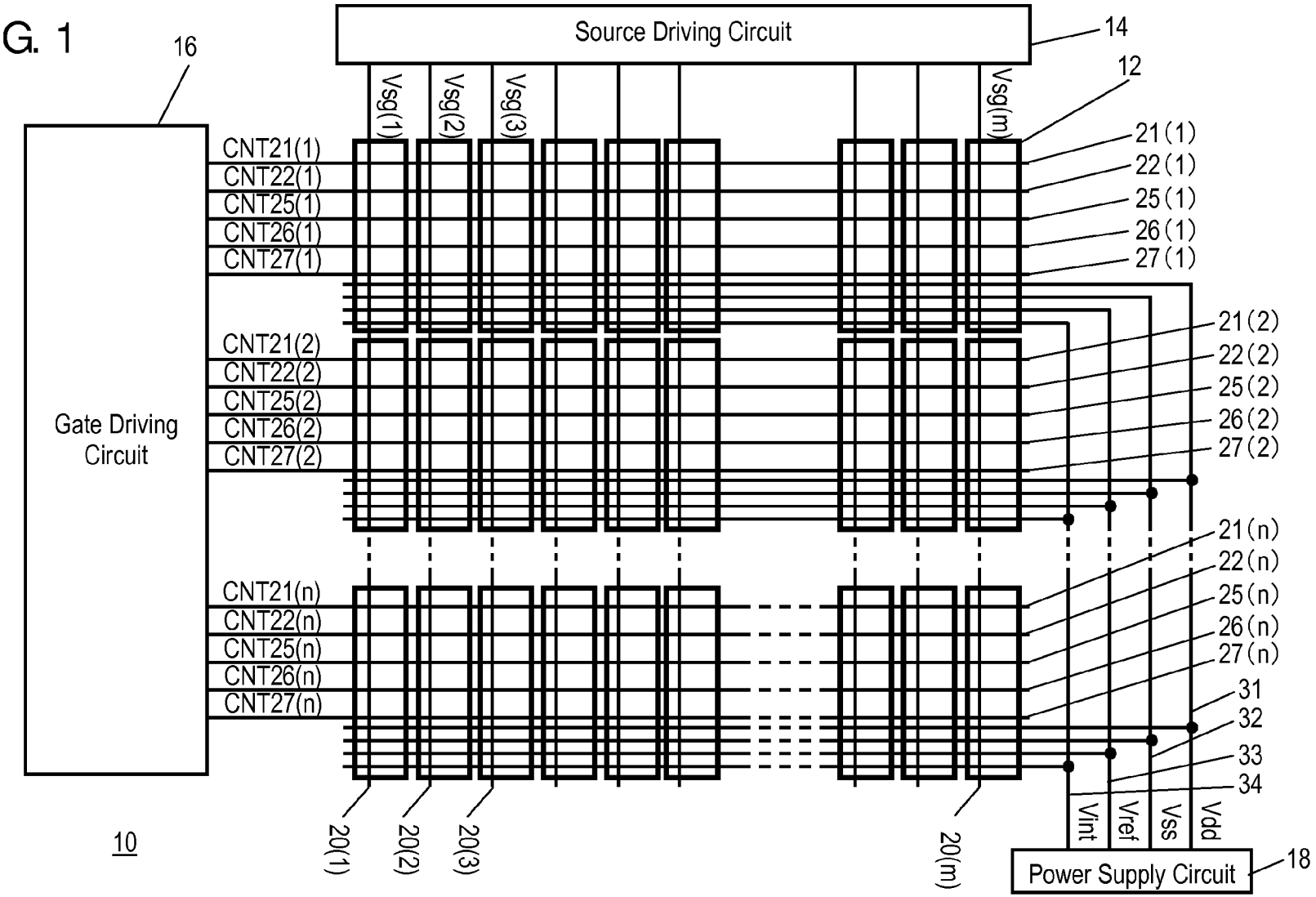
FIG. 1 is a block diagram illustrating a structure of the display apparatus according to a first embodiment.

FIG. 1 is a block diagram illustrating a structure of display apparatus 10 according to the first embodiment. Display apparatus 10 has a large number of arrayed (n-rows, m-column) pixel circuits 12 (*i, j*) (1<=i<=n and 1<=j<=m), source driving circuit 14, gate driving circuit 16, and power supply circuit 18.

As shown in FIG. 1, source driving circuit 14 supplies image signal voltage Vsg (j) (j represents each of the pixel columns 1 to m, m being the highest number) to each of data lines 20 (*j*) connected commonly to pixel circuits 12 (1, j) to 12 (*n, j*) which are aligned in column. Gate driving circuit 16 supplies control signals CNT21 (*i*), CNT22 (*i*), CNT25 (*i*), CNT26 (*i*), CNT27 (*i*) (i represents each of the pixel rows 1 to n, n being the highest number) to control signal lines 21(*i*), 22(*i*), 25(*i*), 26(*i*), 27(*i*) which are connected commonly to pixel circuits 12 (*i*, 1) to 12 (*i, m*) aligned in row direction. In this embodiment, five kinds of control signals are supplied to one pixel circuit 12 (*i, j*). However, the number of control signals is not limited to five.

Power supply circuit 18 supplies the high-voltage Vdd to power source lines 31 and the low-voltage Vss to power source lines 32. These power source lines are connected to all of the pixel circuits 12 (1, 1) to 12 (*n, m*). The voltages Vdd and Vss are provided so that the organic EL device, which is described later, can emit light. Reference voltage Vref is supplied to voltage lines 33 which are connected to all of pixel circuits 12 (*i, j*). Initialization voltage Vint is supplied to voltage lines 34 which are also connected to all of pixel circuits 12 (*i, j*).

Figure 2:
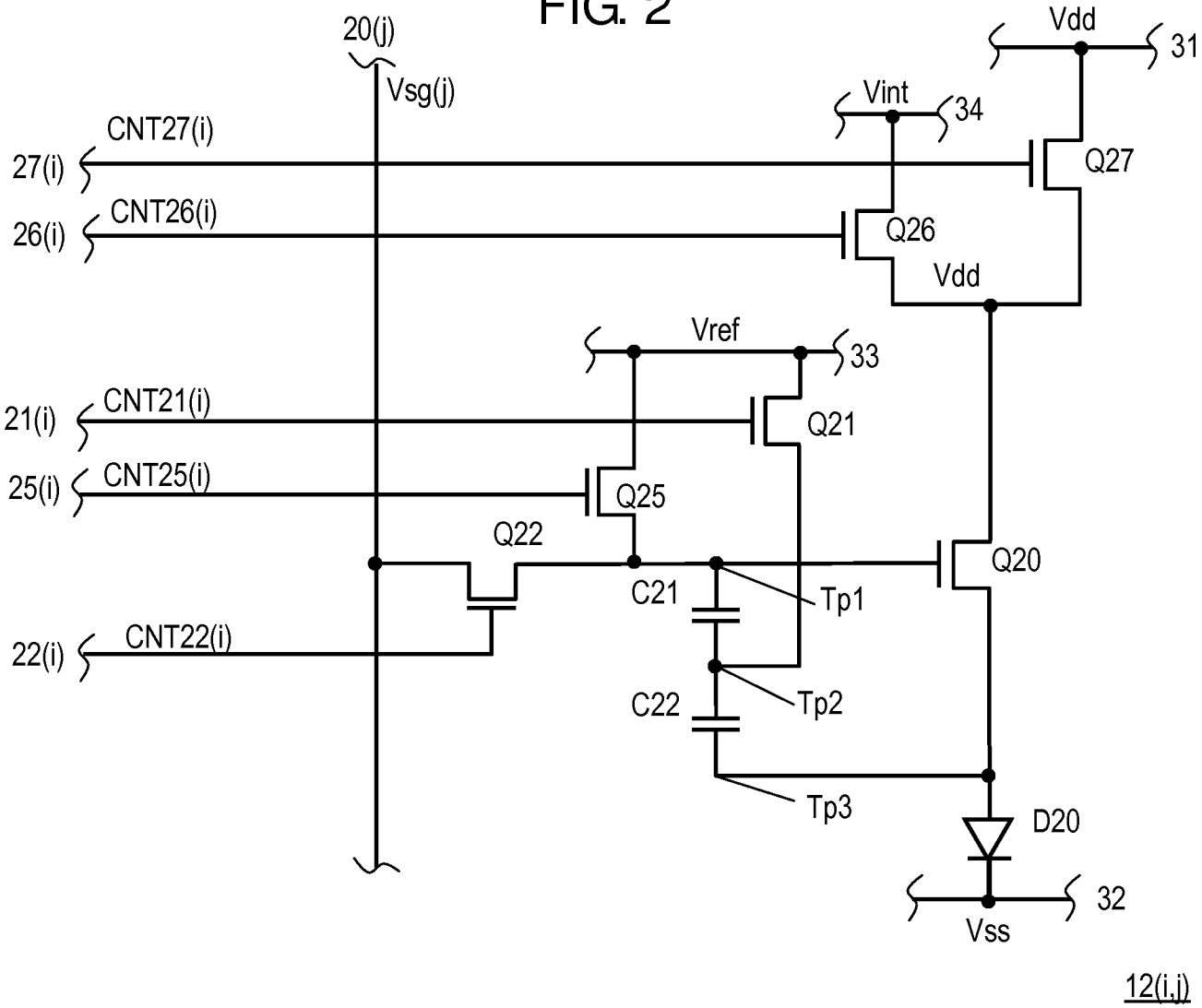
FIG. 2 is a circuit diagram of a pixel circuit of the display apparatus.

FIG. 2 is a circuit diagram of pixel circuit 12 (*i, j*) of display apparatus 10 in the first embodiment. Pixel circuit 12 (*i, j*) has organic EL device D20 (an example of a current light emitting device), driving transistor Q20, first capacitor C21, second capacitor C22, and transistors Q21, Q22, Q25, Q26, Q27 which operate as switches.

Driving transistor Q20 supplies current to organic EL device D20. First capacitor C21 stores image signal voltage Vsg which varies in response to image signal (j). Transistor Q21 is a switch for applying reference voltage Vref to terminals of first capacitor C21 and second capacitor C22. Transistor Q22 is a switch for writing (charging) image signal voltage Vsg (i) to first capacitor C21. Transistor Q25 is a switch for applying reference voltage Vref to a gate of driving transistor Q20. Second capacitor C22 stores threshold voltage Vth of driving transistor Q20. Transistor Q26 is a switch for applying initialization voltage Vint to a drain of driving transistor Q20. Transistor Q27 is a switch for supplying high-voltage Vdd to the drain of driving transistor Q20.

All of driving transistor Q20 and transistors Q21, Q22, Q25, Q26, Q27 are N-channel TFT (Thin Film Transistors) and enhancement type transistors. However, present disclosure is not limited to such a configuration.

Pixel circuit 12 (*i, j*) has a structure that transistor Q27, driving transistor Q20 and organic EL device D20 are connected in series between power source lines 31 and 32. That is, a drain of transistor Q27 is connected to power source line 31, a source of transistor Q27 is connected to the drain of driving transistor Q20, the source of driving transistor Q20 is connected to an anode of organic EL device D20, and a cathode of organic EL device D20 is connected to power source line 32.

First capacitor C21 and second capacitor C22 are connected in series between the gate and source of driving transistor Q20. That is, one terminal (first terminal) of first capacitor C21 is connected to the gate of driving transistor Q20, and second capacitor C22 is connected between the other terminal (second terminal) of first capacitor C21 and the source of driving transistor Q20. Hereafter, a node to which the gate of driving transistor Q20 and first capacitor C21 are connected is called "node Tp1". A node to which first capacitor C21 and second capacitor C22 are connected is called "node Tp2". Anode to which second capacitor C22 and the source of driving transistor Q20 are connected is called "node Tp3".

A drain of transistor Q21 (first switch) is connected to voltage line 33 which supplies reference voltage Vref. A source of transistor Q21 is connected to node Tp2. A gate of transistor Q21 is connected to control signal line 21(*i*). Transistor Q21 thereby applies reference voltage Vref to node Tp2. Transistor Q21 may be a P-channel TFT instead of the N-channel TFT. When the transistor is P-channel TFT, the positions of the gate and source are reverse to that of the N-channel TFT. The same can be applied to the transistors described below.

A drain of transistor Q22 (second switch) is connected to node Tp1. A source of transistor Q22 is connected to data line 20(*j*) which supplies image signal voltage Vsg. A gate of transistor Q22 is connected to control signal line 22(*i*). Transistor Q22 thereby supplies image signal voltage Vsg to the gate of driving transistor Q20.

A drain of transistor Q25 (fifth switch) is connected to voltage line 33 which supplies reference voltage Vref. A source of transistor Q25 is connected to node Tp1, and a gate of transistor Q25 is connected to control signal line 25(*i*).

A drain of transistor Q26 (third switch) is connected to the drain of driving transistor Q20. A source of transistor Q26 is connected to voltage line 34 which supplies initialization voltage Vint. A gate of transistor Q26 is connected to control signal line 26(*i*). Transistor Q26 thereby supplies initialization voltage Vint to the drain of driving transistor Q20.

A drain of transistor Q27 (fourth switch) is connected to power supply line 31. A source of transistor Q27 is connected to the drain of driving transistor Q20. A gate of transistor Q27 is connected to control signal line 27(*i*). Transistor Q27 thus supplies current to the drain of driving transistor Q20 for emitting light from current light emitting device D20.

Control signals CNT21(*i*), CNT22(*i*), CNT25(*i*), CNT26 (*i*), and CNT27(*i*) are supplied respectively to control signal lines 21(*i*), 22(*i*), 25(*i*), 26(*i*), and 27(*i*).

As described above, pixel circuit 12 (*i, j*) according to this embodiment has:

first capacitor C21 having a first terminal connected with a gate of driving transistor Q20;

second capacitor C22 connected between a second terminal of first capacitor C21 and a source of driving transistor Q20;

transistor Q21 (first switch) applying reference voltage Vref to node Tp2 of the capacitors C21 and C22;

transistor Q22 (second switch) supplying image signal voltage Vsg to the gate of driving transistor Q20;

transistor Q25 (fifth switch) applying reference voltage Vref to the gate of driving transistor Q20;

transistor Q26 (third switch) supplying initialization voltage Vint to a drain of driving transistor Q20, and transistor Q27 (fourth switch) supplying current to the drain of driving transistor Q20 for emitting light from current light emitting device D20.

In this embodiment, the minimum voltage between the anode and cathode of organic EL device D20 for supplying current in the device D20 is 1(V) (this minimum voltage is called Vled hereafter). The capacity between the anode and cathode of the device D20 when the current does not flow in the device D20 is 1 (pF). Threshold voltage Vth of driving transistor Q20 is about 1.5(V). The electric capacity of first capacitor C21 and second capacitor C22 are 0.5 (pF). Regarding to driving voltage, high-voltage Vdd is 10(V), low-voltage Vss is 0(V). Reference voltage Vref and initialization voltage Vint are set so as to meet following two conditions.

$$Vref-Vint>Vth \quad \text{Condition 1}$$

$$Vref<Vss+Vled+Vth \quad \text{Condition 2}$$

In this embodiment, reference voltage Vref is 1(V), and initialization voltage Vint is −1(V). However, these values may change according to the specification of the display apparatus or characteristic of the devices. Thus, it is desirable to set the driving voltage optimally to meet the foregoing conditions and being in accordance with the specification of the display apparatus or characteristic of the devices.

Figure 3A:
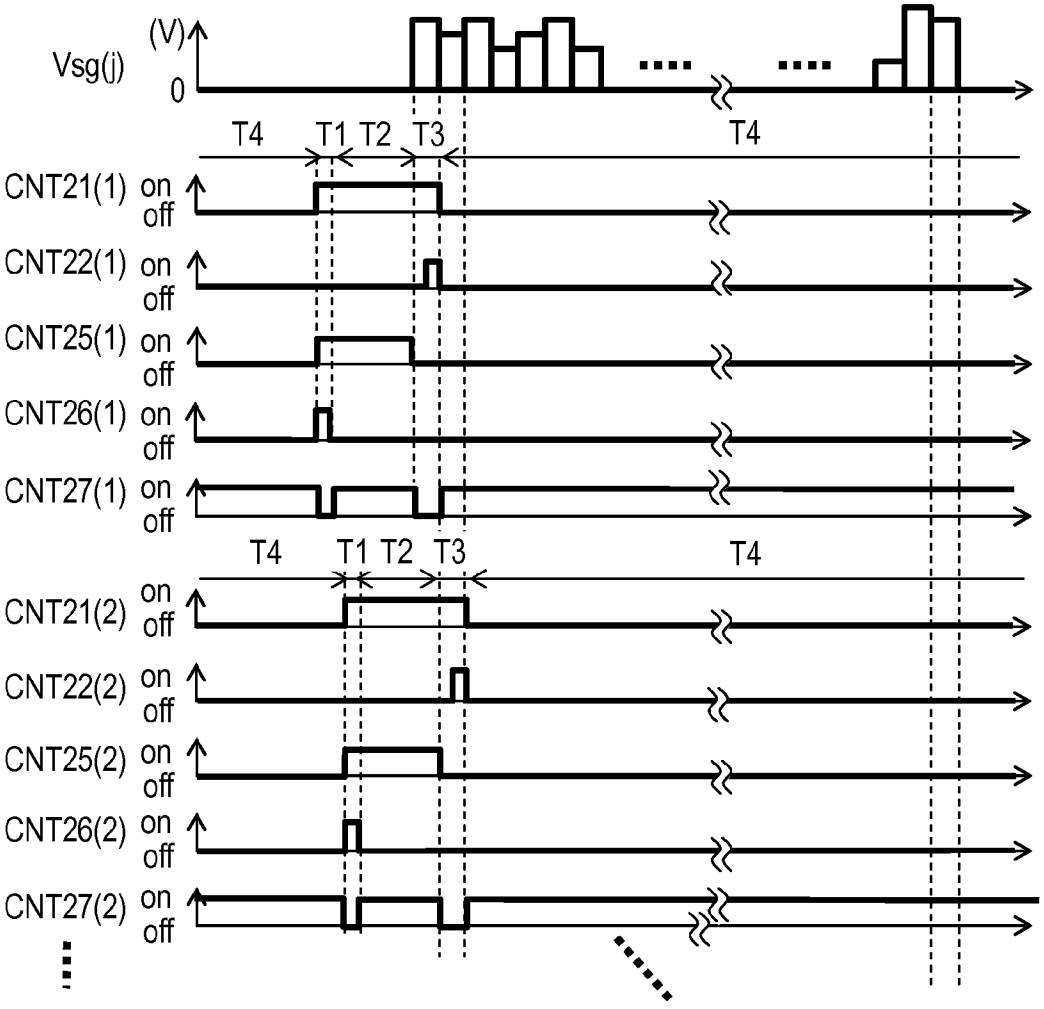
FIG. 3A is a timing diagram illustrating an operation of the display apparatus.
Figure 3B:
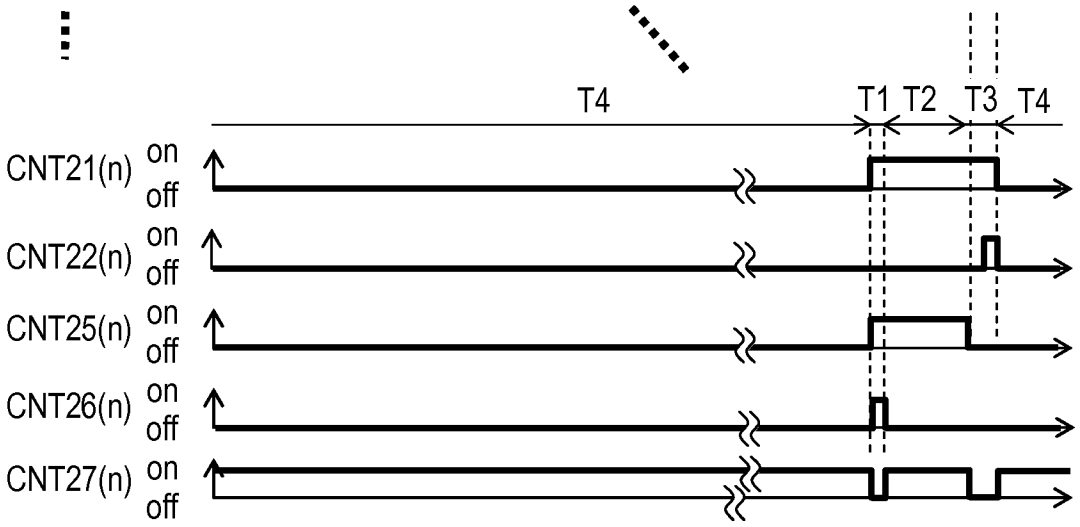
FIG. 3B is a timing diagram illustrating an operation of the display apparatus.

Next, an operation of pixel circuit 12 (*i, j*) according to this embodiment is described. FIGS. 3A and 3B are timing diagrams illustrating an operation of display apparatus 10 of the first embodiment.

As shown in these diagrams, one frame period is divided into four periods (i.e. initialization period T1, threshold detecting period T2, writing period T3, and luminescence period T4) in order to control organic EL devices D20 included in each of the pixel circuits 12 (*i,j*).

In initialization period T1, second capacitor C22 is charged to a predetermined voltage.

In threshold detecting period T2, threshold voltage Vth of driving transistor Q20 is detected.

In writing period T3, image signal voltage Vsg, which varies in response to image signal (j), is written (charged) to first capacitor C21.

In luminescence period T4, a sum of terminal to terminal voltages of first capacitor C21 and second capacitor C22 is applied between the gate and source of driving transistor Q20. This leads to generate a current-flow in organic EL device D20 so that the device D20 can emit light.

The timings of these four periods are set to same for the pixel circuits belonging in the same row (i.e. four periods in the pixel circuits 12 (*i*, 1) to 12 (*i, m*) have the same timing). The timing of writing periods T3 is set differently for each of the different rows so that the period T3 does not overlap in the different row. Accordingly, while a writing operation is being performed on one pixel row, other pixel rows can execute an operation other than the writing. Thus, driving period can be used efficiently.

Figure 4:
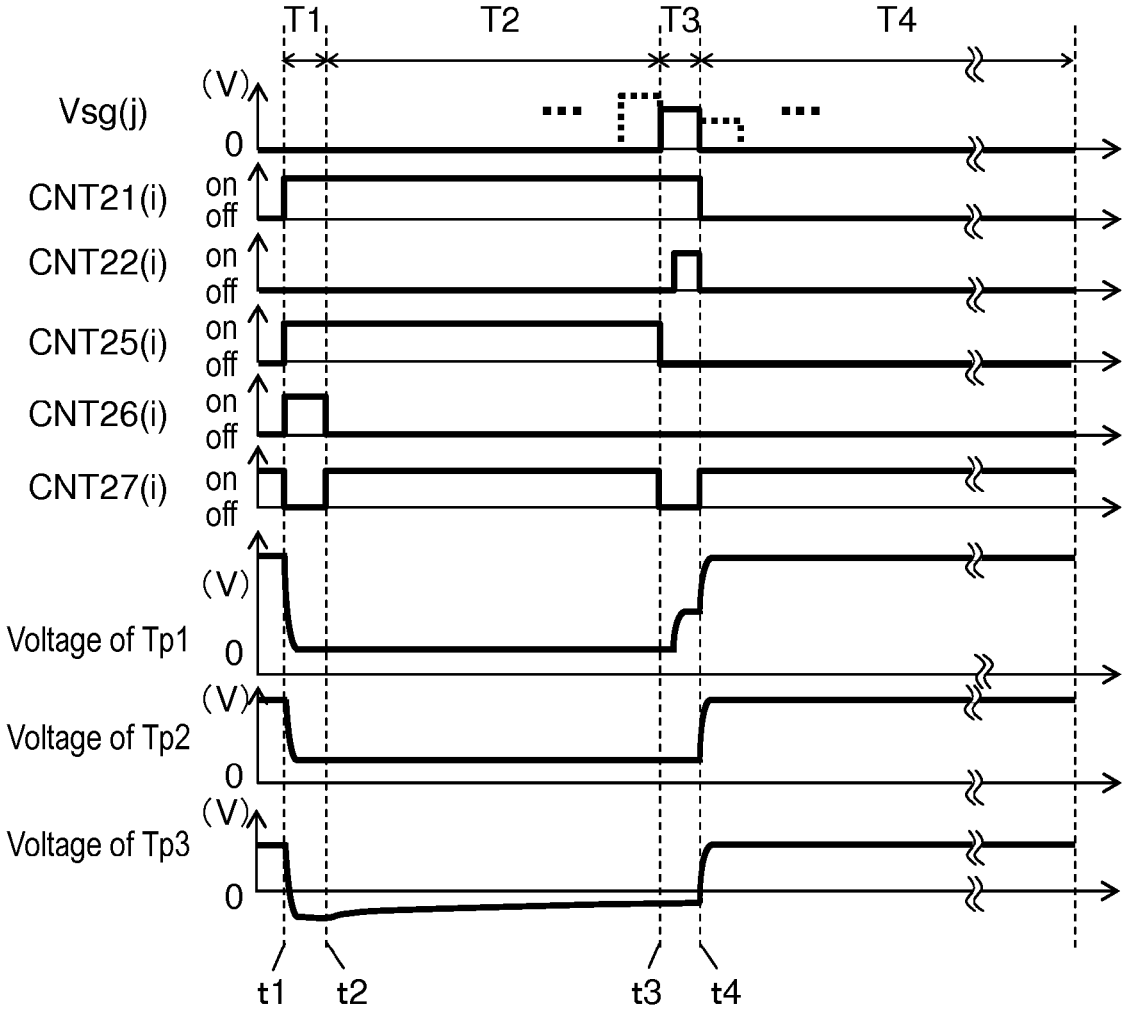
FIG. 4 is a timing diagram illustrating an operation of the pixel circuit of the display apparatus.

FIG. 4 is a timing diagram illustrating an operation of pixel circuit 12 (*i, j*) of display apparatus 10 according to the first embodiment. In FIG. 4, changes of voltages in the nodes Tp1 to Tp3 are also illustrated. Hereafter, the operation of pixel circuit 12 (*i, j*) is detailed for each of the divided periods.

Initialization Period T1

Figure 5:
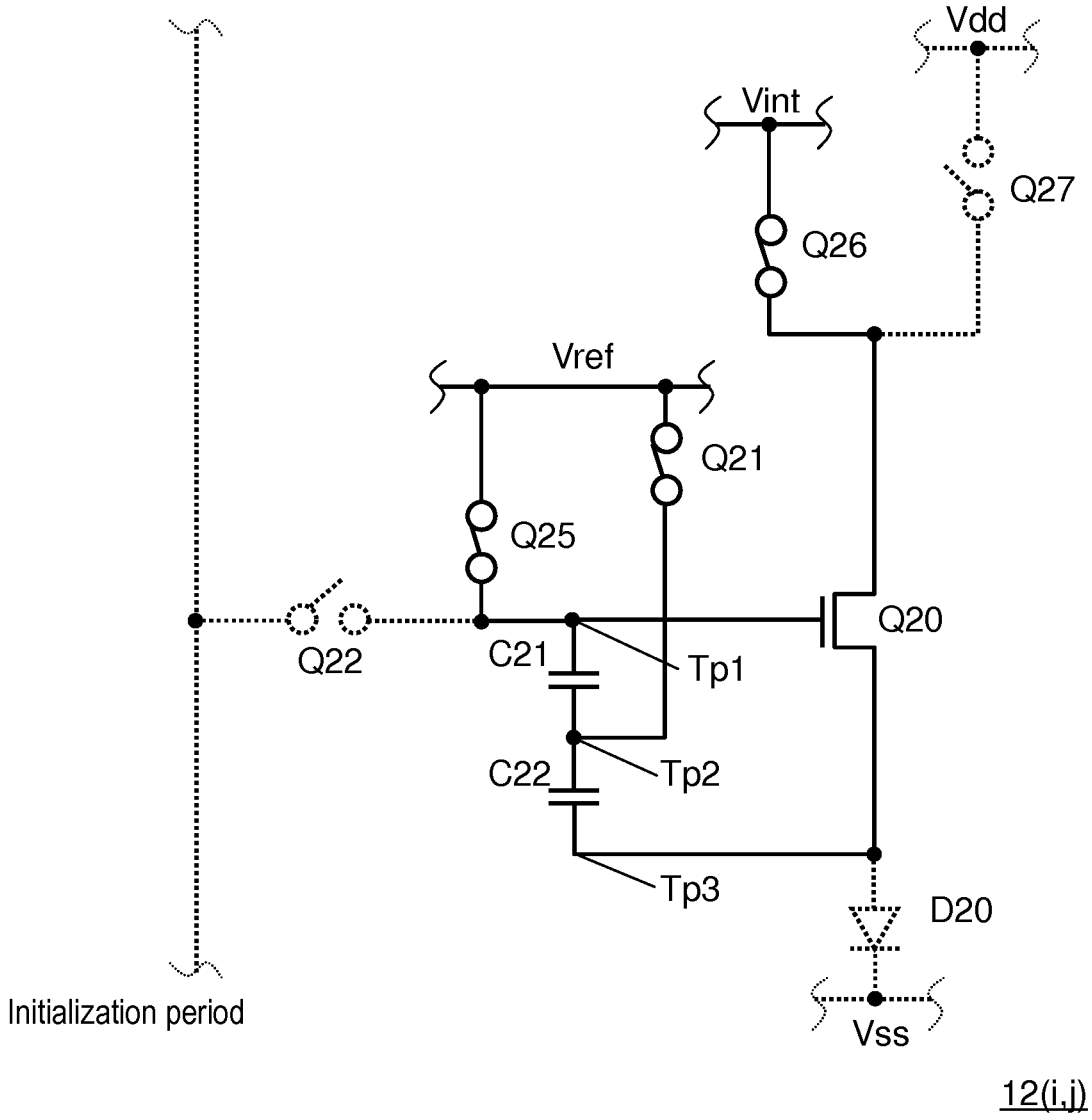
FIG. 5 is a circuit diagram for illustrating an operation of the pixel circuit during the initialization period.

FIG. 5 is a circuit diagram for illustrating an operation of pixel circuit 12 (*i, j*) during initialization period T1. In FIG. 5, transistors Q21, Q22, Q25, Q26, and Q27 (of FIG. 2) are shown by symbols of switches. The path to which current does not flow is shown by dotted line.

At time t1, while control signals CNT22(*i*) and CNT27 (*i*) are set to low level to set transistors Q22 and Q27 OFF, control signals CNT21(*i*), CNT25(*i*), and CNT26(*i*) are set to high level to set transistor Q21, Q25, and Q26 ON. Reference voltage Vref is thereby applied to node Tp1 via transistor Q25, and reference voltage Vref is also applied to node Tp2 via transistor Q21.

Initialization voltage Vint is applied to the drain of driving transistor Q20 via transistor Q26. As derived from Condition 1, initialization voltage Vint is set to a voltage which is lower than (Vref−Vth). As a result, a voltage which is almost equal to initialization voltage Vint is applied to the source of driving transistor Q20. At this point, voltage Vref is applied to one terminal of second capacitor C22 and voltage Vint is applied to the other terminal of second capacitor C22. In other words, the voltage (Vref−Vint), which is higher than threshold voltage Vth, is charged in second capacitor C22.

Further, as derived from the conditions 1 and 2, initialization voltage Vint is set to a voltage lower than a sum of low voltage Vss and voltage Vled, i.e. Vint<Vss+Vled. Accordingly, the voltage difference between node Tp3 and Vss (Vint−Vss) is lower than voltage Vled. Thus, current does not flow into organic EL device D20 and the device D20 does not emit light.

In this embodiment, initialization period T1 is set to 1 micro second.

Threshold Detection Period T2

Figure 6:
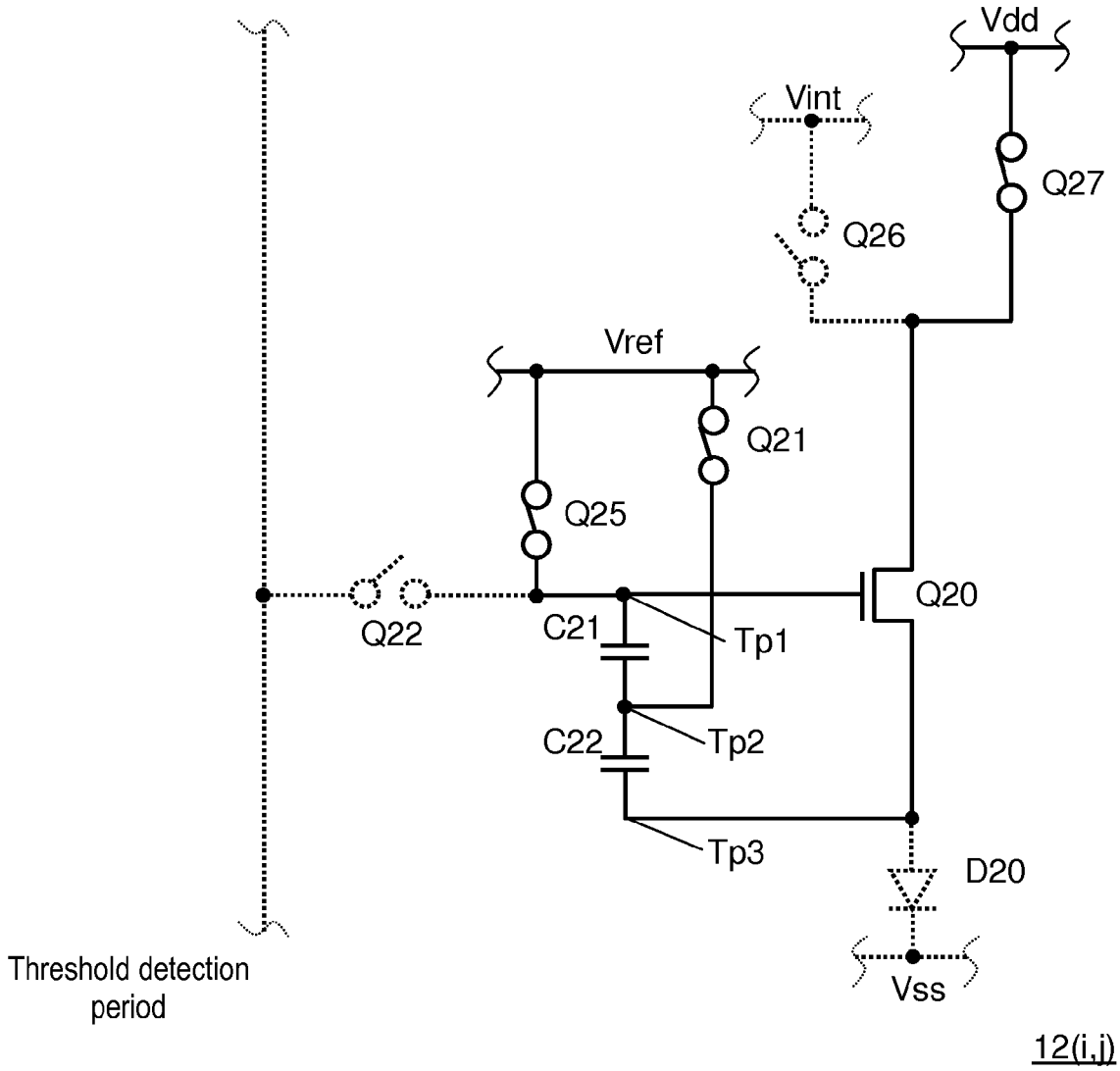
FIG. 6 is a circuit diagram for illustrating an operation of the pixel circuit during the threshold detecting period.

FIG. 6 is a circuit diagram for illustrating an operation during threshold detection period T2 of pixel circuit 12 (*i, j*).

At time t2, control signal CNT26(*i*) is set to low level to set transistor Q26 OFF and control signal CNT27(*i*) is set to high level to set transistor Q27 ON. As a result, a voltage that is higher than voltage Vth (i.e. voltage (Vref−Vint), which is the terminal to terminal voltage V22 of second capacitor C22) is applied between the gate and source of driving transistor Q20. This leads to generate a current-flow in driving transistor Q20.

However, the voltage of the anode of organic EL device D20 is still lower than the voltage (Vref−Vth), i.e. Vref−Vth<Vss+Vled, as derived from Condition 2. This means that the voltage of the anode is lower than a sum of the voltages Vss and Vled, thus the current does not flow in the device D20.

Next, second capacitor C22 is discharged by the current supplied to driving transistor Q20, and thus voltage V22 start decreasing. However, since voltage V22 is still higher than threshold voltage Vth, current keeps flowing although the amount of the current continues to decrease in driving transistor Q20. Voltage V22 thereby decreases gradually to threshold voltage Vth. The current-flow in driving transistor Q20 stops when voltage V22 falls to threshold voltage Vth. The voltage V22 also stops decreasing at this point.

The current flowing in driving transistor Q20 decreases as the voltage V22 decreases because the driving transistor Q20 operates as a current source which is controlled by the G-S voltage. As a result, a long time is required before voltage V22 falls to threshold voltage Vth. Moreover, the long time requirement is further caused because the large electric capacity of organic EL device D20 is added to the electric capacity of second capacitor C22. Practically, this takes 10 to 100 times longer than the case of discharging the capacitor by transistor switching. For this reason, threshold detection period T2 is set to 10 micro seconds in this embodiment.

Writing Period T3

Figure 7:
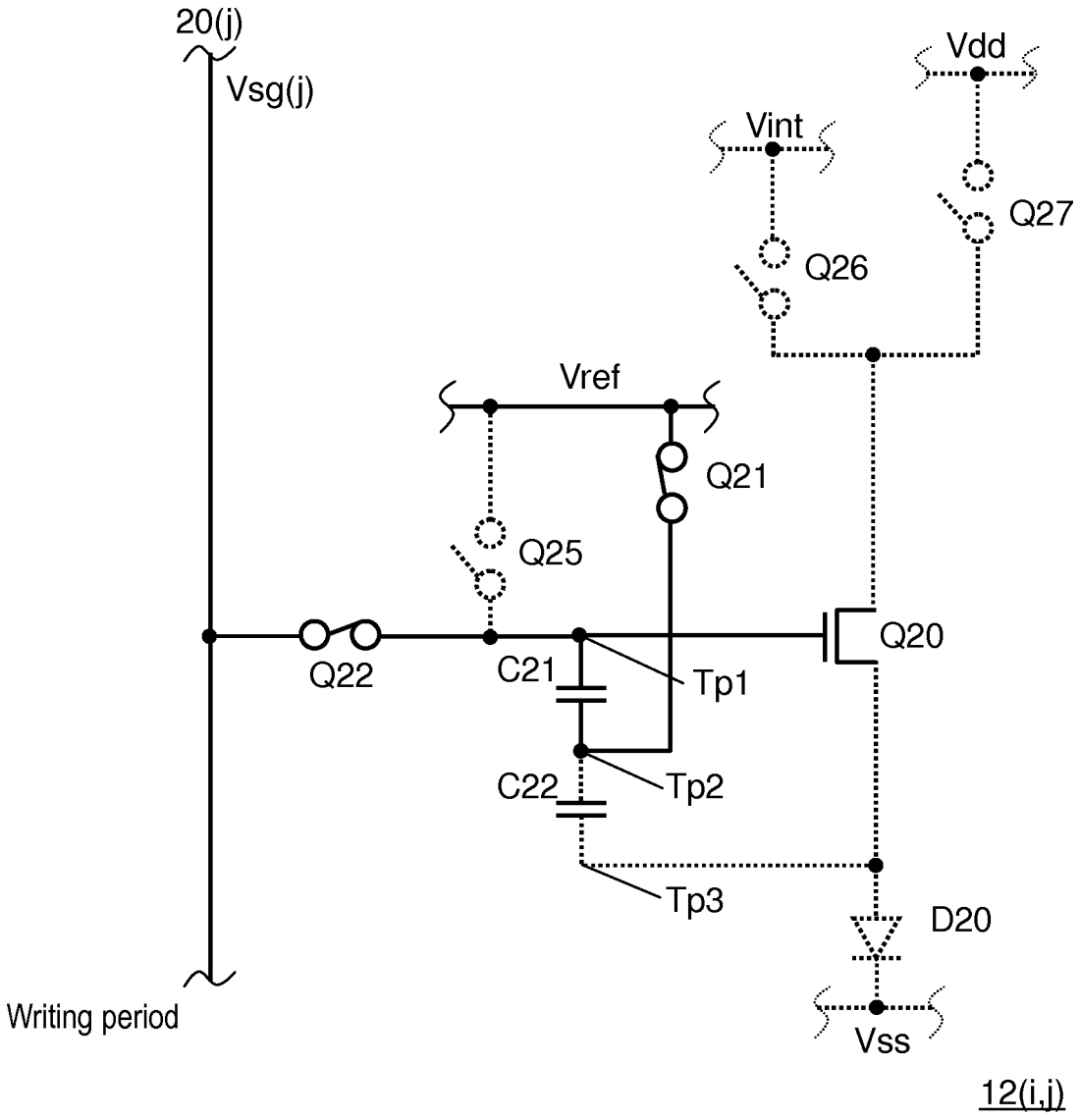
FIG. 7 is a circuit diagram for illustrating an operation of the pixel circuit during the writing period.

FIG. 7 is a circuit diagram for illustrating an operation during writing period T3 in pixel circuit 12 (*i, j*) of the first embodiment.

At time t3, control signal CNT25(*i*) is set to low level to set transistor Q24 OFF and control signal CNT27(*i*) is set to low level to set transistor Q27 OFF. Then control signal CNT22(*i*) is set to high level to set transistor Q22 ON. As a result, the voltage of node Tp1 becomes equal to image signal voltage Vsg (j), and voltage (Vref−Vsg) is charged between two terminals of first capacitor C21. Hereafter, this voltage (Vref−Vsg) is referred to as image signal voltage Vsg'. At this point, voltage V22 does not change because the current does not flow in driving transistor Q20.

In this embodiment, writing period T3 is set to 1 micro second.

Luminescence Period T4

Figure 8:
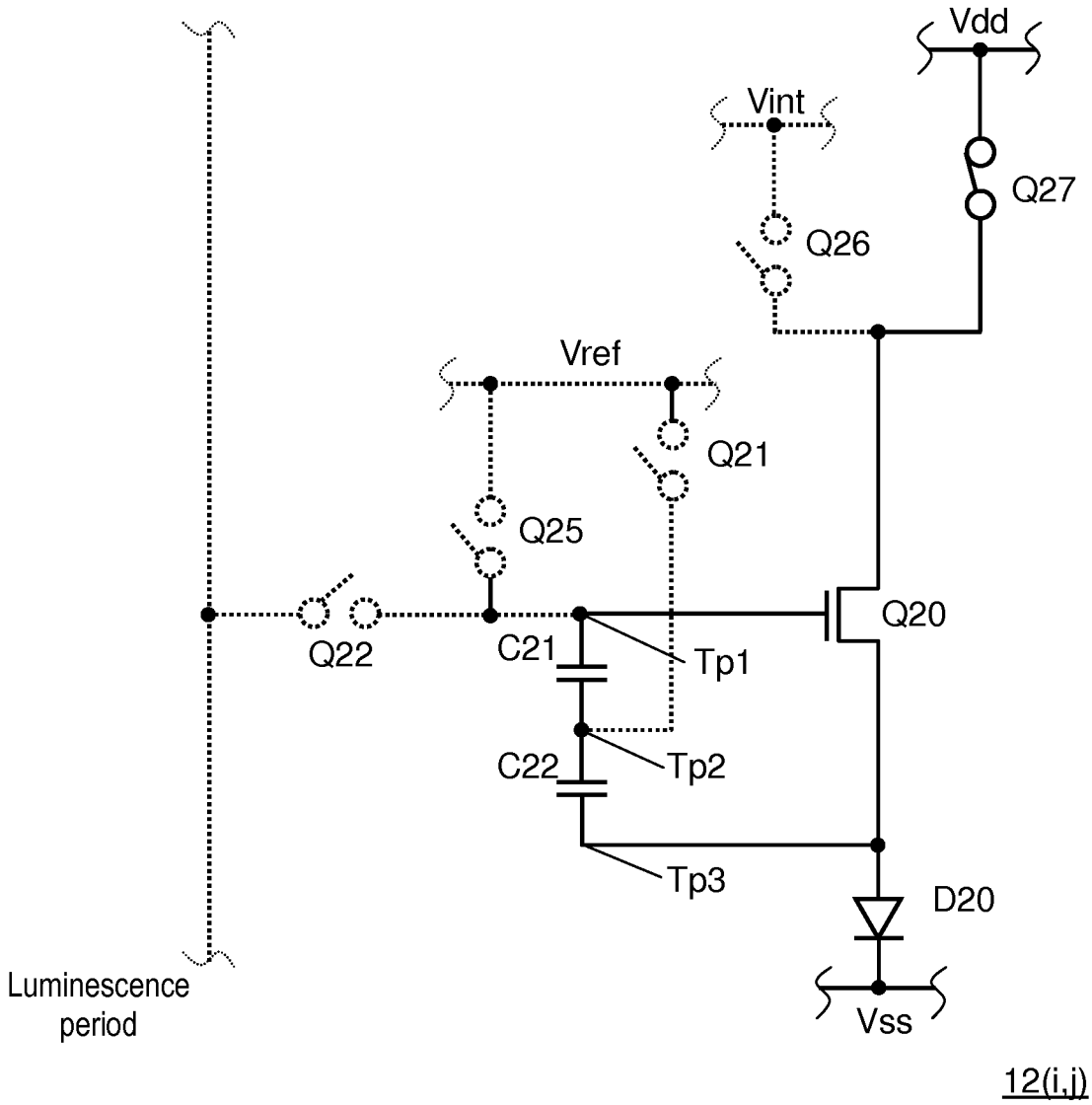
FIG. 8 is a circuit diagram for illustrating an operation of the pixel circuit during the luminescence period.

FIG. 8 is a circuit diagram for illustrating an operation of pixel circuit 12 (*i, j*) during luminescence period T4.

At time t4, control signal CNT22(*i*) is set to low level to set transistor Q22 OFF. Control signal CNT21(*i*) set to low level to set transistor Q21 OFF. Accordingly, nodes Tp1 to Tp3 temporarily enter a floating state. Then control signal CNT27 (*i*) is set to high level to set transistor Q27 ON. However, since voltage (Vsg'+Vth) is applied between the gate and source of driving transistor Q20, the source voltage rises and current corresponding to G-S voltage of driving transistor Q20 is supplied to organic EL device D20.

At this point, current (I) satisfies I=K*(VGS−Vth)=K*Vsg' (where, VGS is the G-S voltage, and K is a constant value), and does not include threshold voltage Vth.

As discussed above, the current flowing in organic EL device D20 is not influenced by threshold voltage Vth. Therefore, current flowing in organic EL device D20 is free from dispersion of threshold voltage Vth of driving transistor Q20. Further, even when threshold voltage Vth changes with the time, organic EL device D20 can emit light at luminosity corresponding to the image signal.

After writing period T3, a non-light emitting period having an adequate length can be set at an adequate timing. This period can be achieved by setting control signal CNT27(*i*) to low level by setting OFF transistor Q27. As a result, current stops flowing in driving transistor Q20 and light stop emitting from organic EL device D20. The path for discharging first capacitor C21 and second capacitor C22 is cut off during the non-lighting period. Consequently, terminal to terminal voltages of first capacitor C21 and second capacitor C22 are maintained. The non-lighting period can be restored to luminescence period T4 by setting control signal CNT27(*i*) to high level and setting transistor Q27 ON.

Although it is desirable to set transistor Q25 ON in threshold detection period T2, transistor Q25 can be set OFF as the leakage current of the first capacitor C21 is negligibly small. In this case, control signals CNT25(*i*) and CNT26(*i*) can be shared because the transistors Q25 and Q26 can be controlled by the same signal.

In this embodiment, every pixel circuits 12 (*i, j*) have transistors Q21, Q22, Q25, Q26, and Q27. However, transistor Q26 (the third switch) and transistor Q27 (the fourth switch) can be commonly used by multiple pixel circuits 12 (*i, j*). Hereafter, a pixel circuit which shares the third switch and the fourth switch is detailed.

Second Embodiment

The structure of display device 10 according to the second embodiment is similar to that of the first embodiment illustrated in FIG. 1. However, configuration of pixel circuit 12 (*i, j*) differs from that of first embodiment. The pixel circuit of the second embodiment has individual circuits provided independently to each of organic EL devices D20, which is an example of current light emitting device, and shared circuits provided commonly to multiple current light emitting devices.

Figure 9:
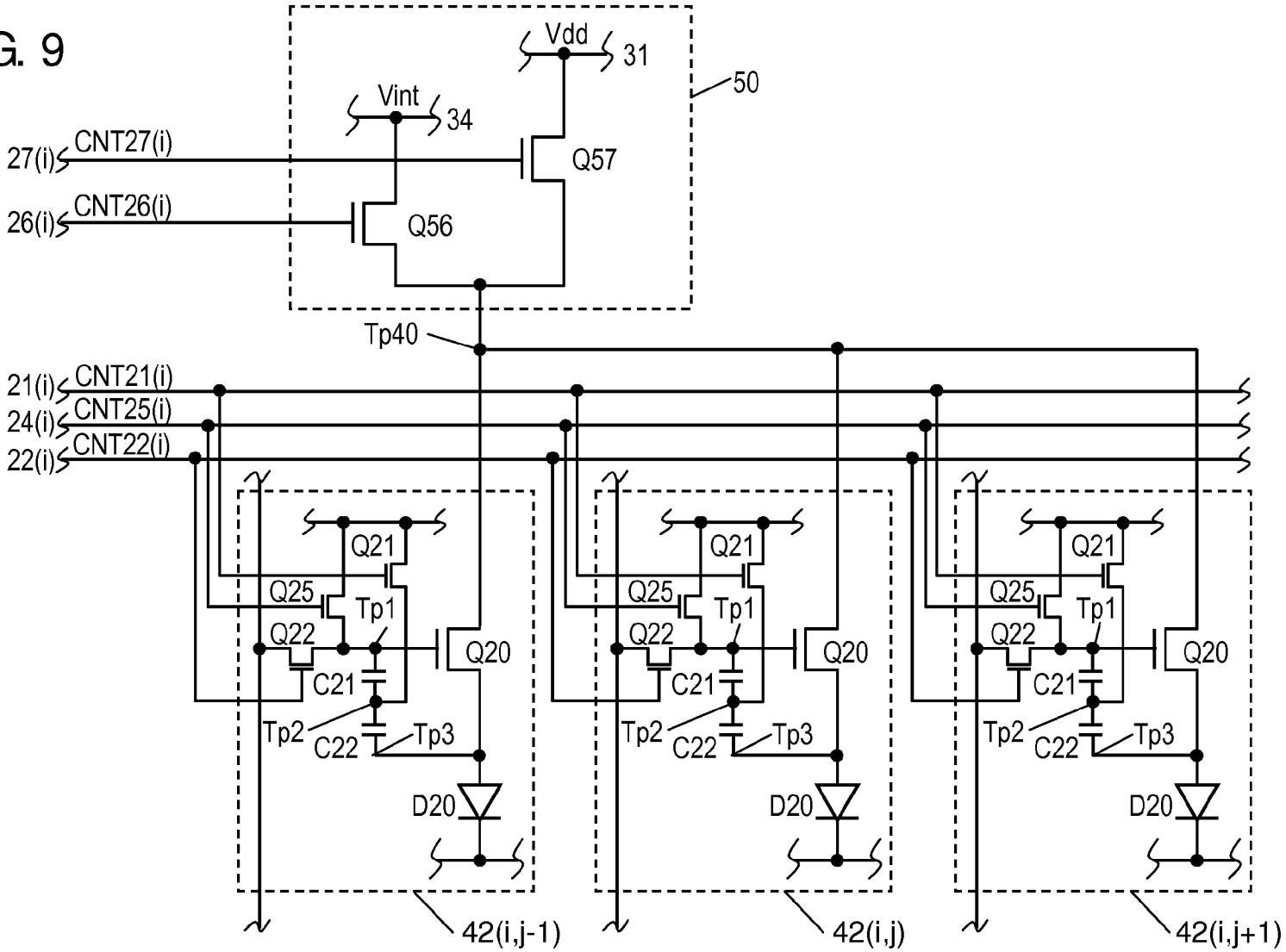
FIG. 9 is a circuit diagram of a pixel circuit of the display apparatus according to a second embodiment.

FIG. 9 is a circuit diagram of pixel circuit 12 (*i, j*) of display apparatus 10 according to the second embodiment. FIG. 9 illustrates three individual circuits 42 (*i, j*−1), 42 (*i, j*), and 42 (*i, j*+1) and one common circuit 50 for these individual circuits. Pixel circuit 42 (*i, j*) in the second embodiment has organic EL device D20, driving transistor Q20, first capacitor C21, second capacitor C22, transistor Q21 (first switch), transistor Q22 (second switch) and transistor Q25 (fifth switch).

To be specific, first capacitor C21 and second capacitor C22 are connected in series between a gate and source of driving transistor Q20. In other words, a first terminal of first capacitor C21 is connected to the gate of driving transistor Q20, and second capacitor C22 is connected between a second terminal of first capacitor and the source of driving transistor Q20.

A drain of transistor Q21 is connected to voltage line 33 which supplies reference voltage Vref. A source of transistor Q21 is connected to node Tp2. Agate of transistor Q21 is connected to control signal line 21(*i*).

A drain of transistor Q22 is connected to node Tp1. A source of transistor Q22 is connected to data line 20(*j*). A gate of the transistor Q22 is connected to control signal line 22(*i*).

A drain of the transistor Q25 is connected to voltage line 33 which supplies reference voltage. A source of transistor Q25 is connected to node Tp1. Agate of transistor Q25 is connected to control signal line 25(*i*).

The source of driving transistor Q20 is connected to the anode of organic EL device D20. The cathode of organic EL device D20 is connected to power source line 32.

Common circuit 50 in the second embodiment has transistor Q56 (the third switch) and transistor Q57 (the fourth switch). These two transistors are shared by three individual circuits 42 (*i, j*−1), 42 (*i, j*), and 42 (*i, j*+1).

Each of the drains of driving transistors Q20 of individual circuits 42 (*i, j*−1), 42 (*i, j*), and 42 (*i, j*+1) is connected together at a connecting point (node Tp40). A drain of transistor Q56 of common circuit 50 is connected to node Tp40. A source of the transistor Q56 is connected to the voltage line 34 which supplies the initialization voltage Vint. A gate of transistor Q56 is connected to control signal line 26(*i*). Initialization voltage Vint can be applied simultaneously to the each of the drains of driving transistors Q20 of individual circuits 42 (*i, j*−1), 42 (*i, j*), and 42 (*i, j*+1) by setting control signal CNT26 to high-level and setting transistor Q56 ON.

A source of the transistor Q57 of common circuit 50 is connected to node Tp40, a drain of transistor Q57 is connected to power source line 31, and a gate of transistor Q57 is connected to control signal line 27(*i*). Thus, high-voltage Vdd can be applied simultaneously to each of the drains of driving transistors Q20 of individual circuits 42 (*i, j*−1), 42 (*i, j*), and 42 (*i, j*+1) by setting control signal CNT27 to high level and set transistor Q57 ON.

As described above, pixel circuit of this embodiment has driving transistor Q20, first capacitor C21, second capacitor C22, transistor Q21 (first switch), transistor Q22 (second switch), and transistor Q25 (fifth switch) all of which are provided for every current light emitting devices D20. The pixel circuit further has transistor Q56 (third switch) and transistor Q57 (fourth switch) which are provided commonly to multiple devices D20.

The operations of individual circuit 42 (*i, j*) and common circuit 50 according to the second embodiment are similar to those of the first embodiment provided that transistors Q26 and Q27 are replaced with transistors Q56 and Q57, respectively. Similarly to the first embodiment, one-frame period is divided into initialization period T1, threshold value detection period T2, writing period T3, and luminescence period T4 in order to control organic EL devices D20 in each of individual circuits 42 (*i, j*).

In initialization period T1, second capacitor C22 is charged to a predetermined voltage. In threshold detection period T2, threshold voltage Vth of driving transistor Q20 is detected. In writing period T3, image signal voltage Vsg(j) corresponding to an image signal is charged to first capacitor C21. In luminescence period T4, a sum of the terminal to terminal voltage of first capacitor C21 and second capacitor C22 is applied between the gate and source of driving transistor Q20 in order to supply current to organic EL device D20. Light is thereby emitted from the device D20.

The timing of these four periods are set commonly to individual circuits 42 (*i, j*−1), 42 (*i, j*), and 42 (*i, j*+1) which shares a single common circuit 50 of FIG. 9.

As discussed above, by sharing the third switch and the fourth switch with multiple individual circuits 42 (*i, j*), the number of the transistors per pixel circuit is reduced and the area occupied by the transistor per pixel is thereby reduced. This contributes to an achievement of a high-definition display apparatus. Further, since this structure allows achieving a high seizing rate of the organic EL device D20 in a pixel, high luminance display apparatus can be achieved.

The number of individual circuits 42 (*i, j*) sharing one common circuit 50 can be set optimally according to the maximum current of organic EL device D20, an ON resistance of transistor Q57, and layout of each of the devices. In this context, "ON resistance" means the resistance between the drain and source electrodes of a transistor when the transistor is ON.

Third Embodiment

Figure 10:
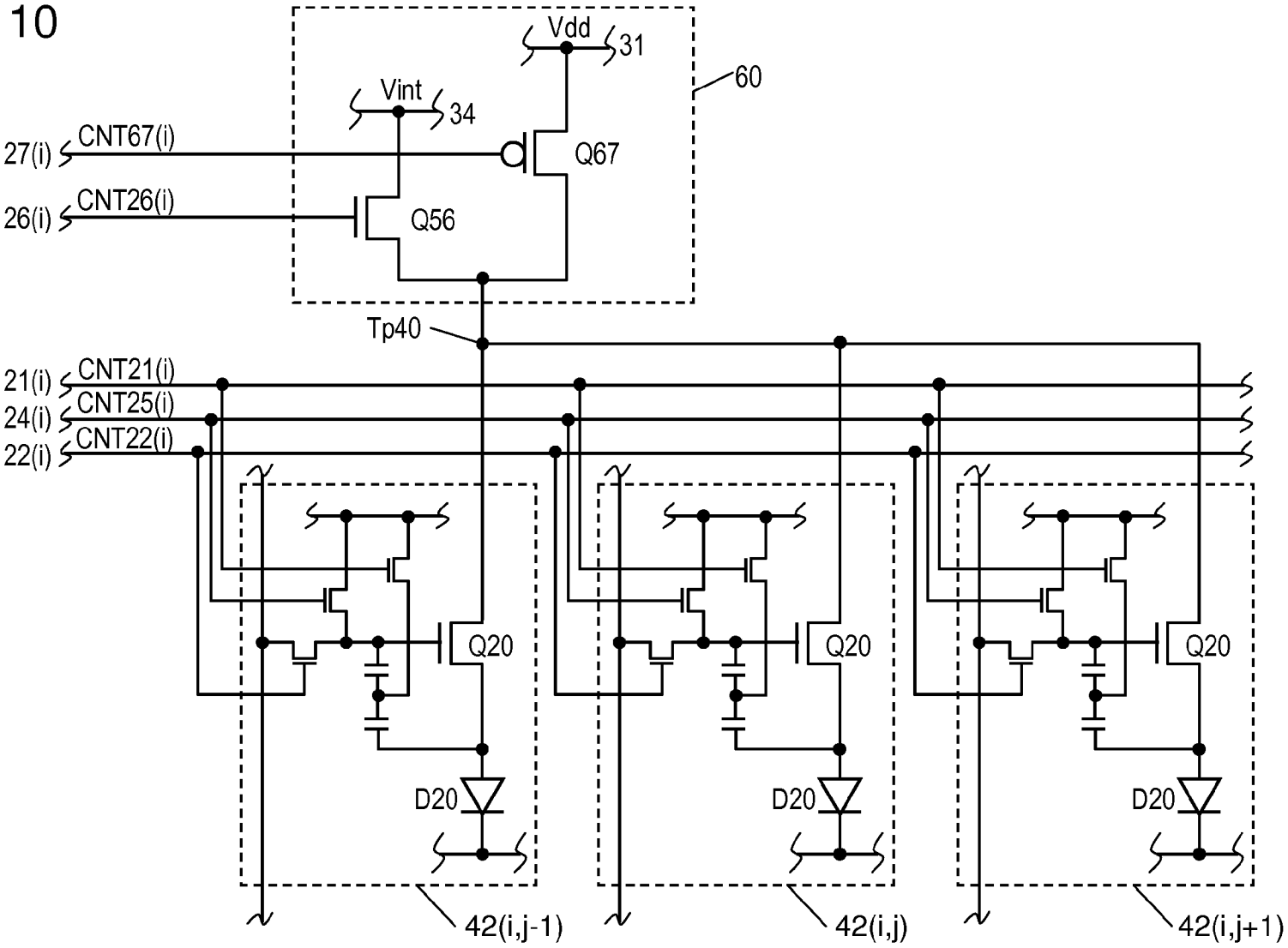
FIG. 10 is a circuit diagram of a pixel circuit of the display apparatus according to a third embodiment.

FIG. 10 is a circuit diagram of a pixel circuit in display device 10 according to the third embodiment. FIG. 10 illustrates three individual circuits 42 (*i, j*−1), 42 (*i, j*), and 42 (*i, j*+1) and one common circuit 60 for these individual circuits. The configuration and the operation of individual circuits 42 (*i, j*) are the same as those in the second embodiment, and a detail description thereof is omitted.

Similar to common circuit 50 of FIG. 9, common circuit 60 in the third embodiment has the following structure: a drain of transistor Q56 (third switch) is connected to node Tp40; a source of transistor Q56 is connected to voltage line 34; a gate of transistor Q56 is connected to control signal line 26(*i*); a source of transistor Q67 (fourth switch) is connected to node Tp40; a drain of transistor Q67 is connected to power source line 31, and a gate of transistor Q67 is connected to control signal line 67(*i*). However, common circuit 60 of the third embodiment differs from common circuit 50 of the second embodiment that a P channel TFT is used as a fourth switch.

Generally a P-channel TFT can reduce ON resistance in high voltage. This lowers power consumption of the fourth switch compared to when n-channel TFT is employed as the fourth switch.

Fourth Embodiment

Similar to the second embodiment, pixel circuit 12 of display apparatus 10 according to the fourth embodiment has individual circuits provided independently for each of current light emitting devices, and a common circuit provided commonly for multiple current light emitting devices.

Figure 11:
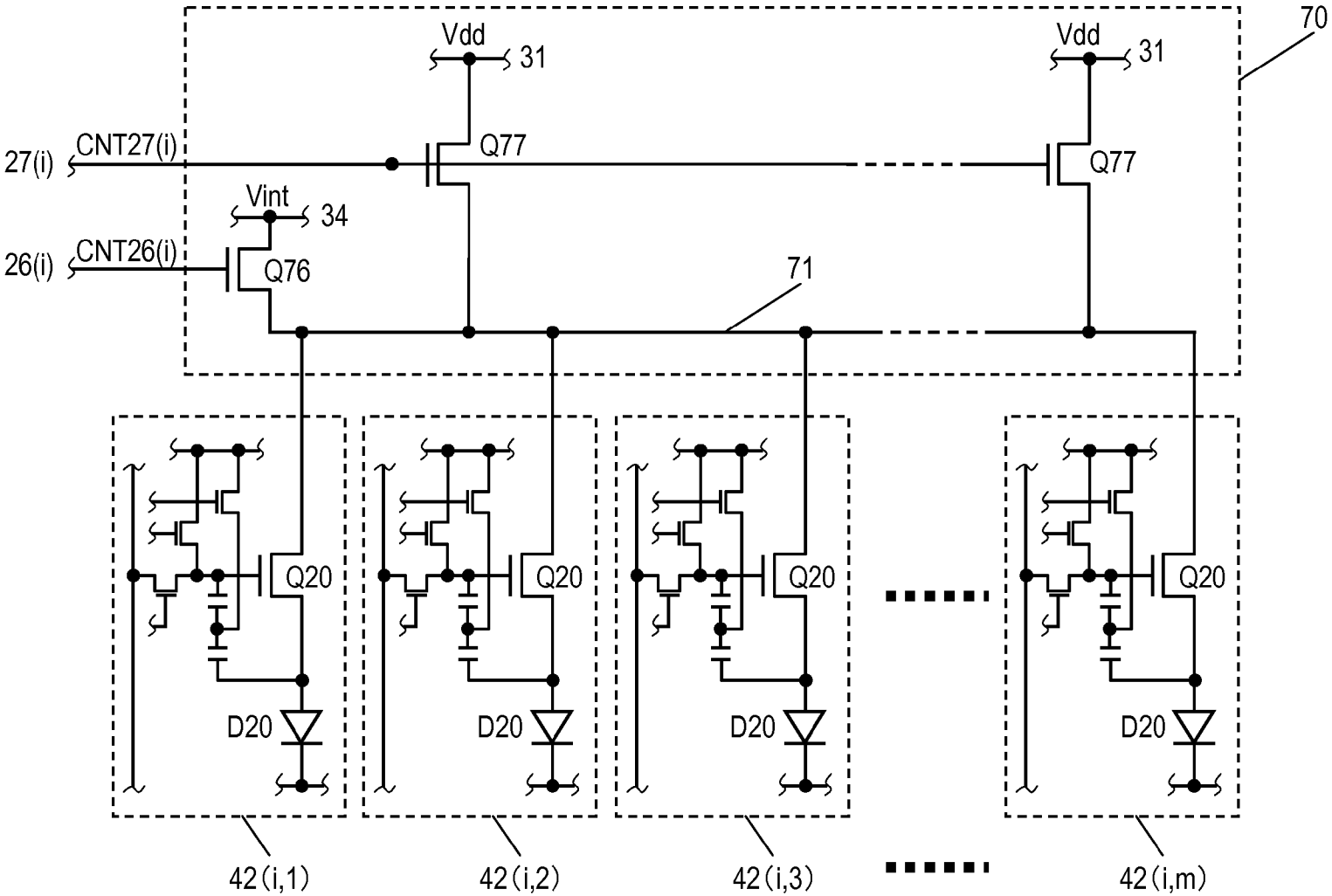
FIG. 11 is a circuit diagram of a pixel circuit of the display apparatus according to a fourth embodiment.

FIG. 11 is a circuit diagram of a pixel circuit of display device 10 according to the fourth embodiment. FIG. 11 illustrates m individual circuits 42 (*i*, 1) to 42 (*i, m*) arranged in row-direction and common circuit 70 provided commonly to these individual circuits. The configuration and operation of individual circuit 42 (*i, j*) is similar to those of the second embodiment, and a detailed description thereof are omitted.

According to the pixel circuit of the fourth embodiment, common circuit 70 is provided for each of the rows having m organic EL devices D20. Each of common circuit 70 has drain connection line 71, transistor Q76 (third switch) and multiple transistors Q77 (fourth switches).

Drain connection line 71 is connected with each of the driving transistors Q20 in m individual circuits 42 (*i*, 1) to 42 (*i, m*) arranged in row direction.

A drain of transistor Q76 (third switch) is connected to drain connection line 71. A source of transistor Q76 is connected to voltage line 34 which supplies initialization voltage Vint. Agate of transistor Q76 is connected to control signal line 26(*i*). Control signal CNT26 is set to high-level to set transistor Q76 ON. Initialization voltage Vint is thus applied simultaneously to the drains of each of the driving transistors Q20 in individual circuits 42(*i*,1) to 42(*i,m*).

Each of the drains of transistors Q77 (fourth switch) is connected to power source line 31. Each of the sources of transistors Q77 is connected to drain connection line 71. Each of the gates of transistors Q77 is connected to control signal line 27(*i*). Control signal CNT27 is set to high level to set transistor Q77 ON. High voltage Vdd is thus applied simultaneously to the drains of each of the driving transistors Q20 in individual circuits 42(*i*, 1) to 42(*i, m*).

As discussed above, common circuit 70 of this embodiment has the following structure: transistor Q76 (third switch) is provided commonly to one row consisted by m current light emitting devices arranged in the row direction, and transistor Q77 (fourth switch) is provided commonly to multiple current light emitting devices included in one row.

During initialization period, transistor Q76 is set to ON in order to apply initialization voltage Vint simultaneously to each of the drains of driving transistors Q20 in individual circuits 42 (*i*, 1) to 42 (*i, m*). The current flowing in transistor Q76 is very small because this current is for charging each of second capacitors. Accordingly, m individual circuits 42 (*i*, 1) to 42 (*i, m*) can share a single transistor Q76.

In luminescence period T4, transistor Q77 is set to ON in order to supply current to organic EL device D20 in each of individual circuits 42 (*i*, 1) to 42 (*i, m*). In this case, the total amount of the current flow is large compared to the amount of current flowing in the transistor Q76 during the initialization period T1. For this reason, multiple transistors Q77 are arranged along drain connection line 71 as shown in FIG. 11. The number of individual circuits 42 (*i, j*) sharing one transistor Q77 can be determined according to the maximum current flow of organic EL device D20, the ON resistance of transistor Q77, and the layout of each of the devices, etc. In this embodiment, three individual circuits 42 (*i, j*) share one transistor Q77.

Each of the numerical values such as voltages in the first to fourth embodiments, or the number of the individual circuits sharing one shared transistor in the second to fourth embodiments are examples. These values may be set optimally based on characteristics of organic EL device or specification of the display apparatus.

INDUSTRIAL APPLICABILITY

The present disclosure is useful for an active-matrix display apparatus employing a current light emitting device.

The invention claimed is:

1. A display apparatus having a plurality of arrayed pixel circuits, each of the pixel circuits comprising:
a current light emitting device;
a driving transistor supplying current to the current light emitting device;
a first capacitor having a first terminal connected to a gate of the driving transistor;
a second capacitor connected between a second terminal of the first capacitor and a source of the driving transistor;
a first switch applying a reference voltage to a node at which the first capacitor and the second capacitor are connected;
a second switch supplying an image signal voltage to the gate of the driving transistor;
a third switch supplying an initialization voltage to a drain of the driving transistor;
a fourth switch supplying current to the drain of the driving transistor for emitting light from the current light emitting device, and
a fifth switch applying the reference voltage to the gate of the driving transistor,
wherein each of the pixel circuits is driven to have: an initialization period for charging the second capacitor to a predetermined voltage; a threshold detecting period for detecting a threshold voltage of the driving transistor following the initialization period; a writing period for writing the image signal voltage to the first capacitor following the threshold detecting period; and a luminescence period for causing the current light emitting device to emit light following the writing period.

2. A display apparatus having a plurality of arrayed pixel circuits, each of the pixel circuits comprising:
a current light emitting device;
a driving transistor supplying current to the current light emitting device;
a first capacitor having a first terminal connected to a gate of the driving transistor;
a second capacitor connected between a second terminal of the first capacitor and a source of the driving transistor;
a first switch applying a reference voltage to a node to which the first capacitor and the second capacitor are connected;
a second switch supplying an image signal voltage to the gate of the driving transistor, and
a fifth switch applying the reference voltage to the gate of the driving transistor,
wherein the display apparatus further comprising:
a third switch supplying an initialization voltage to a drain of the driving transistor, and
a fourth switch supplying current to the drain of the driving transistor for emitting light from the current light emitting device,
wherein the third switch and the fourth switch are provided commonly for a plurality of the current light emitting devices, and
each of the pixel circuits is driven to have: an initialization period for charging the second capacitor to a predetermined voltage; a threshold detecting period for detecting a threshold voltage of the driving transistor following the initialization period; a writing period for writing the image signal voltage to the first capacitor following the threshold detecting period; and a luminescence period for causing the current light emitting device to emit light following the writing period.

3. A display apparatus having a plurality of arrayed pixel circuits, each of the pixel circuits comprising:
a current light emitting device;
a driving transistor supplying current to the current light emitting device;
a first capacitor having a first terminal connected to a gate of the driving transistor;
a second capacitor connected between a second terminal of the first capacitor and a source of the driving transistor;
a first switch applying a reference voltage to a node at which the first capacitor and the second capacitor are connected;
a second switch supplying an image signal voltage to the gate of the driving transistor, and
a fifth switch applying the reference voltage to the gate of the driving transistor, the display apparatus further comprising:
a third switch supplying an initialization voltage to a drain of the driving transistor, and
a fourth switch supplying current to the drain of the driving transistor for emitting light from the current light emitting device,
wherein a plurality of the current light emitting devices are arranged in a current light emitting device row,
the third switch is provided commonly for each of the plurality of the current light emitting devices in the current light emitting device row,
the fourth switch is provided commonly for one or more among the plurality of current light emitting devices included in the current light emitting device row, and
each of the pixel circuits is driven to have: an initialization period for charging the second capacitor to a predetermined voltage; a threshold detecting period for detecting a threshold voltage of the driving transistor following the initialization period; a writing period for writing the image signal voltage to the first capacitor following the threshold detecting period; and a luminescence period for causing the current light emitting device to emit light following the writing period.

4. A display apparatus according to claim 1, wherein the initialization voltage is supplied to initialization voltage lines which are connected commonly to all of the pixel circuits.

5. A display apparatus according to claim 2, wherein the initialization voltage is supplied to initialization voltage lines which are connected commonly to all of the pixel circuits.

6. A display apparatus according to claim 3, wherein the initialization voltage is supplied to initialization voltage lines which are connected commonly to all of the pixel circuits.

7. A display apparatus according to claim 1, wherein the initialization voltage is a predetermined fixed voltage which is lower than a voltage resulting from subtracting a threshold voltage of the driving transistor from the reference voltage.

8. A display apparatus according to claim 2, wherein the initialization voltage is a predetermined fixed voltage which is lower than a voltage resulting from subtracting a threshold voltage of the driving transistor from the reference voltage.

9. A display apparatus according to claim 3, wherein the initialization voltage is a predetermined fixed voltage which is lower than a voltage resulting from subtracting a threshold voltage of the driving transistor from the reference voltage.

10. A display apparatus according to claim 1, wherein a first control signal and a second control signal are shared, the first control signal controlling turning ON or OFF of the third switch, the second control signal controlling turning ON or OFF of the fifth switch.

* * * * *